US007900306B2

(12) United States Patent
Bournand et al.

(10) Patent No.: US 7,900,306 B2
(45) Date of Patent: Mar. 8, 2011

(54) GUIDING DEVICE FOR STRANDS

(75) Inventors: Yves Bournand, Montigny le Bretonneux (FR); Adrian Gnagi, Bern (CN); Hans Tschaggelar, Tscheppach (CN)

(73) Assignee: VSL Internationsl AG, Bern (CH)

( * ) Notice: Subject to any disclaimer, the term of this patent is extended or adjusted under 35 U.S.C. 154(b) by 207 days.

(21) Appl. No.: 12/296,325

(22) PCT Filed: Apr. 20, 2006

(86) PCT No.: PCT/EP2006/061709

§ 371 (c)(1),
(2), (4) Date: Oct. 7, 2008

(87) PCT Pub. No.: WO2007/121782

PCT Pub. Date: Nov. 1, 2007

(65) Prior Publication Data

US 2009/0158535 A1 Jun. 25, 2009

(51) Int. Cl.
*E01D 19/16* (2006.01)

(52) U.S. Cl. ..... 14/22

(58) Field of Classification Search ..... 14/18, 21, 14/22, 23; 52/223.3

See application file for complete search history.

(56) References Cited

U.S. PATENT DOCUMENTS

| | | | | |
|---|---|---|---|---|
| 4,505,081 | A * | 3/1985 | Dinis et al. | 52/223.14 |
| 4,848,052 | A * | 7/1989 | Nutzel | 52/223.13 |
| 5,573,852 | A * | 11/1996 | Thal | 428/378 |
| 6,634,147 | B2 * | 10/2003 | Nutzel | 52/223.1 |
| 6,880,193 | B2 * | 4/2005 | Figg et al. | 14/21 |
| 7,003,835 | B2 * | 2/2006 | Figg et al. | 14/21 |
| 7,200,886 | B2 * | 4/2007 | Nuetzel et al. | 14/22 |

FOREIGN PATENT DOCUMENTS

| | | | |
|---|---|---|---|
| DE | 88 10 423.0 | U1 | 11/1988 |
| DE | 199 34 872 | A1 | 3/2001 |
| GB | 1277489 | A | 6/1972 |

OTHER PUBLICATIONS

International Search Report dated Jan. 19, 2007.

* cited by examiner

*Primary Examiner* — Gary S Hartmann
(74) *Attorney, Agent, or Firm* — Peaerne & Gordon LLP

(57) ABSTRACT

Guiding device (1) for strands (2), the guiding device (1) comprising a body (5) in which at least one curved channel (6) is made, including a longitudinal axis curved according to the curvature of said channel (6) and a first part (8) which, situated in principle at the side of the intrados of the longitudinal axis (7), permits, in the limit of the length of the channel (6), the support of the strand (2) on at least one portion of the peripheral face (10) which this strand (2) presents.

11 Claims, 6 Drawing Sheets

GUIDING DEVICE FOR STRANDS

FIELD OF THE INVENTION

The invention relates to a guiding device for strands.

The invention also relates to constructions comprising the aforementioned guiding device for strands.

BACKGROUND OF THE INVENTION

The invention applies in particular, but not exclusively, to the achievement of guiding devices for strands of cables which, made up of a multiplicity of strands, are used in civil engineering and building activities.

In fact, numerous structures in the field and notably bridges comprise cables which are used in particular to support elements of these structures and/or hold them between them.

Such cables are stressed in traction between their opposite ends, but frequently guiding devices are used for holding them laterally and locally in such a manner as to deviate them in whatever way in the direction in which they must extend.

The function of a guiding device of the type cited above is thus to permit lateral and local holding of a cable and transfer of the stress caused by this deviation to a support provided for this purpose.

A guiding device of the aforementioned type is intended to be interposed between the support and the cable.

Conventionally, such a guiding device is conceived to allow individual lateral and local support of each strand of cable.

To this end, a guiding device comprises at least one bearing area for guiding for a strand of cable, and preferably a plurality of bearing areas for deviation, each permitting the individual support of one of the strands of a cable.

A guiding device is made up of a body, generally solid, in which at least one curved channel is made, referred to as channel, intended to be traversed by the strand.

The body conventionally comprises at least as many channels as the guide cable comprises strands.

Conventionally, the strands are each made up of a multiplicity of wires, generally metallic, but not limited thereto.

The strands often have a cross section which is inscribed in a circle, but this section can also be oval or of another shape.

The channels each have a cross section of substantially complementary shape to that of the strand which they must receive.

For example, when the strands of the cable each have a cross section which inscribes a circle, each channel has a cross section substantially circular of a diameter greater than the circle in which the cross section of a strand is inscribed.

It can be borne in mind that each channel of the body comprises a curved longitudinal axis and at least one first part which, situated in principle at the side of the intrados of the longitudinal axis, permits, within the limit of the length of the channel, the support of the strand on a portion of the peripheral face of said strand.

It can likewise be borne in mind that each channel comprises at least a second part which, situated in principle at the side of the extrados of the longitudinal axis, is connected to the first part and enables guiding the strand during its engagement in the channel in order to shape it in a plane of curvature that contains the longitudinal axis of said channel.

Designated by longitudinal axis is an axis which extends along the longitudinal dimension of the channel, but not obligatorily in a median position with respect to the transverse dimension of the channel in a plane of curvature of this channel.

The longitudinal axis indicated has as a function to permit the definition of an intrados and of an extrados, the intrados being a first zone situated on the inside of the curve formed by this longitudinal axis, and the extrados being a second zone situated on the exterior of the curve formed by said longitudinal axis.

Conventionally, each channel is of circular cross section.

Referring to the illustration, the body of the device is made up of a mass of concrete, and each channel is formed by the passage of a curved tube embedded in said concrete mass.

Whatever the case may be, the devices of this type have their advantages, but one very much regrets that the strands which traverse these guiding devices can displace themselves axially, after mounting, and when they are under load and subjected to variations in tension from one side or the other of the guiding device.

SUMMARY OF THE INVENTION

A result which the invention aims to obtain is a guiding device of the aforementioned type with which the strands are better held and are, owing to this fact and to a great extent, less sensitive to stresses that tend to displace them axially.

To this end, the invention has as an object a guiding device according to claim 1.

The invention likewise relates to constructions comprising the aforementioned guiding device for strands.

BRIEF DESCRIPTION OF THE DRAWINGS

The invention will be better understood from reading the following description, given by way of non-limiting example, with reference to the attached drawing representing schematically.

DETAILED DESCRIPTION

Figure 1:
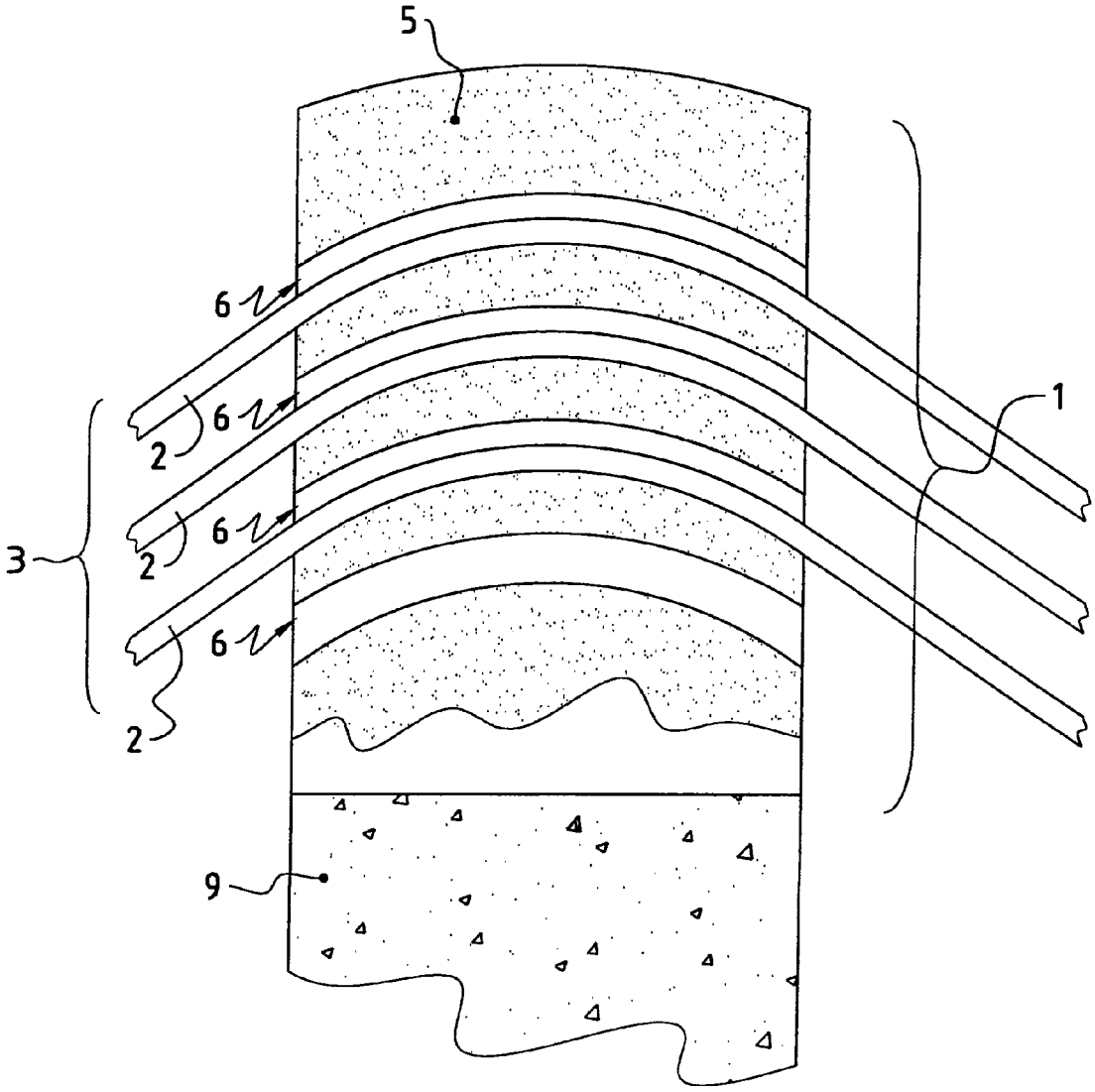
FIG. 1: the guiding device according to the invention, seen in section along a longitudinal plane.
Figure 2:
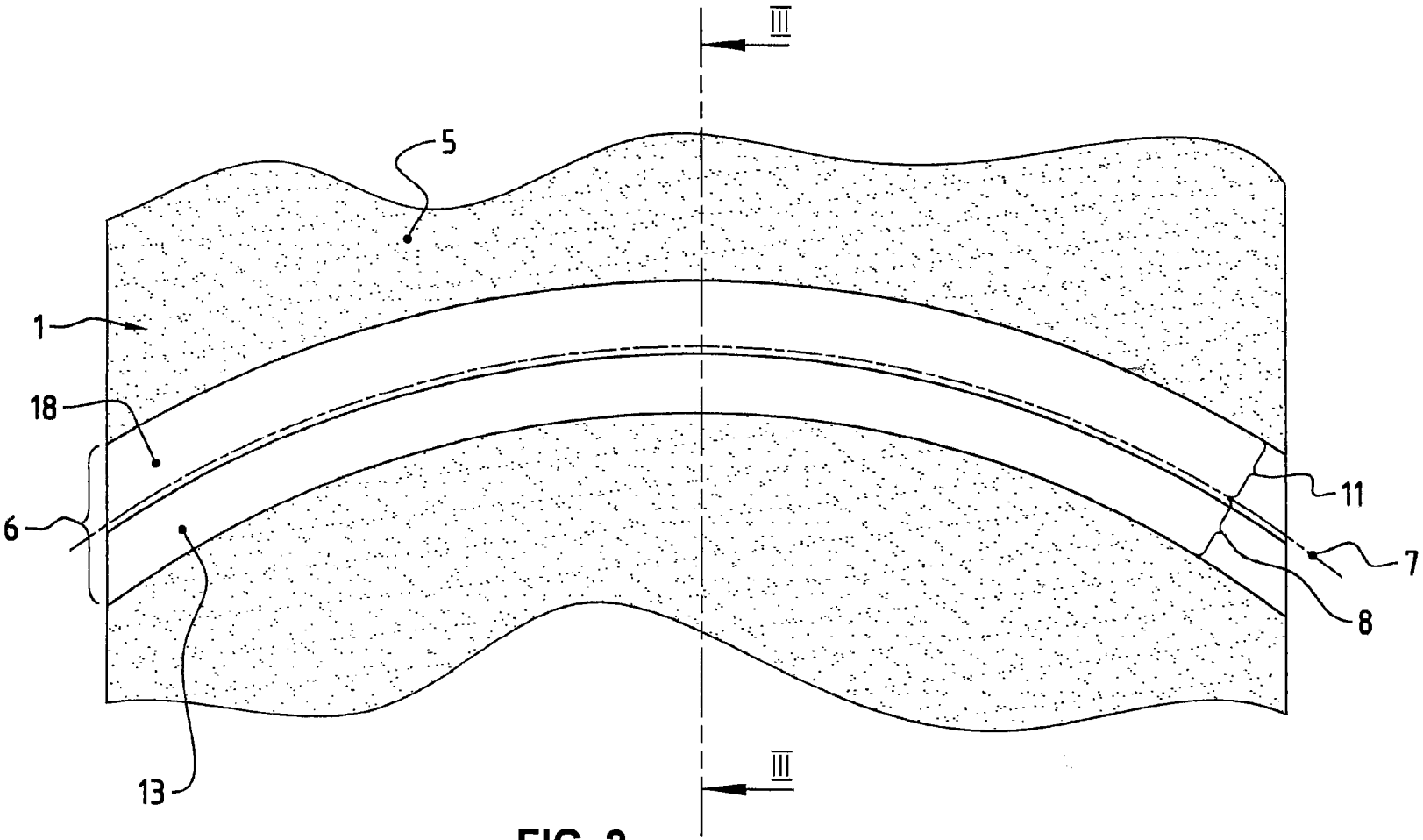
FIG. 2: seen on a much larger scale, a detail of the device of FIG. 1 showing one of the channels of the device.
Figure 3:
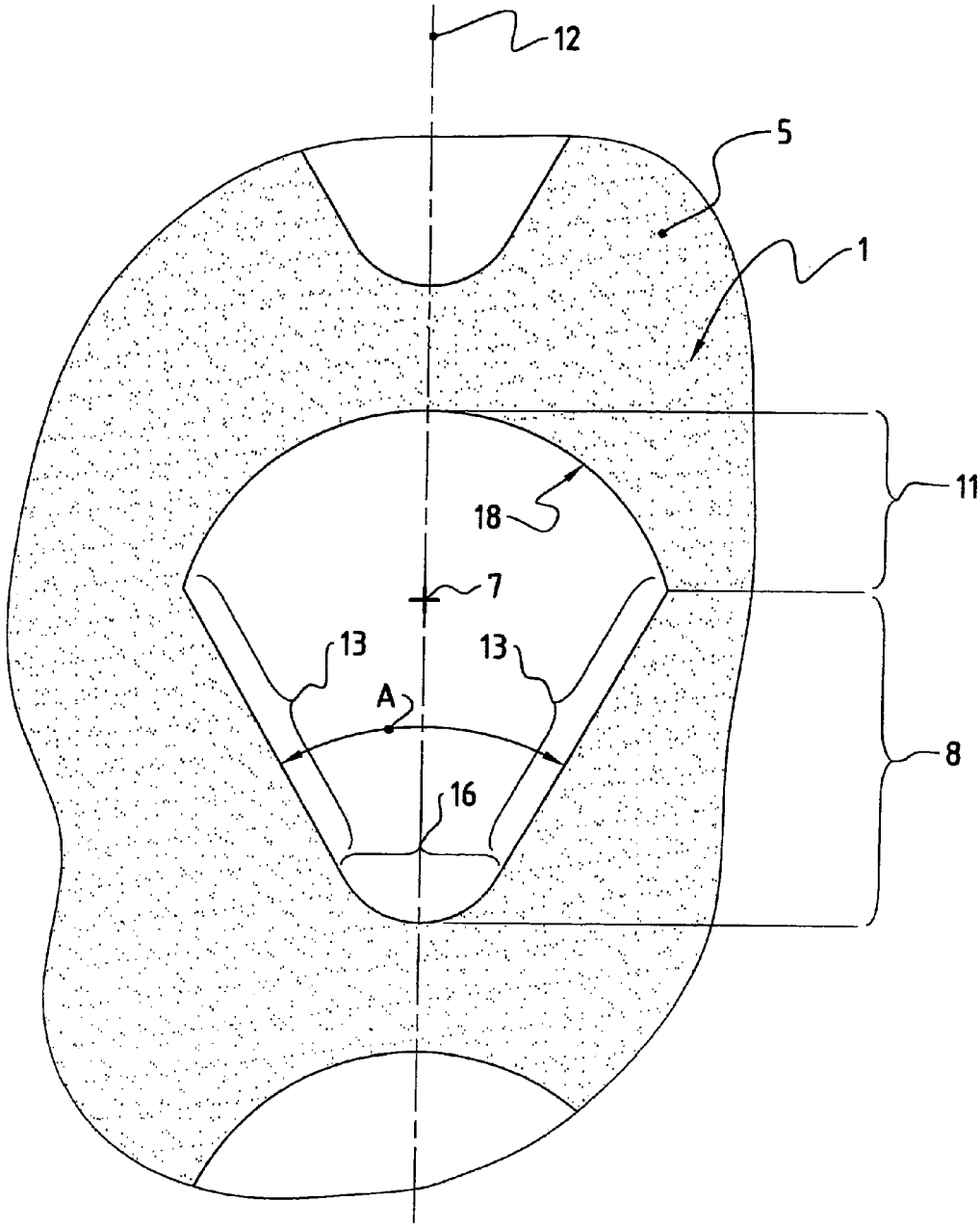
FIG. 3: a view in section of the detail of FIG. 2, according to the plane III-III.

Referring to the drawing, one sees a guiding device 1 for strands 2.

For example, it relates to a guiding device 1 for the strands 2 of a cable made up of a plurality of strands 2.

Conventionally, the strands 2 are each made up of a multiplicity of wires 4, in particular metallic.

For example, the strand 2 comprises a group of seven wires 4.

The strands 2 represented have a cross section which is inscribed in a circle, but they could also be inscribed in an oval or in another shape.

Figure 4:
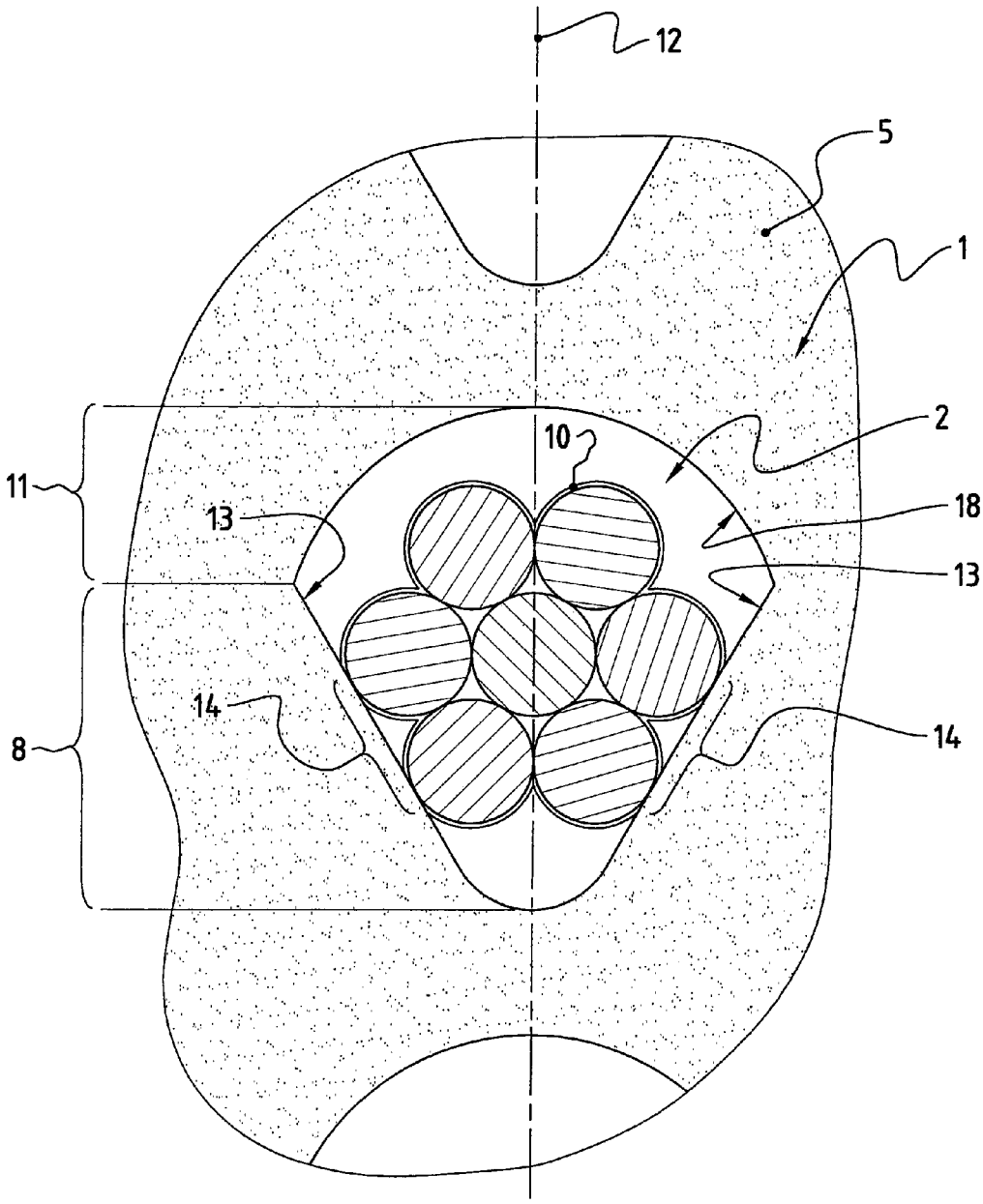
FIGS. 4 and 5: the detail of FIG. 3, when a strand traverses the channel.
Figure 5:
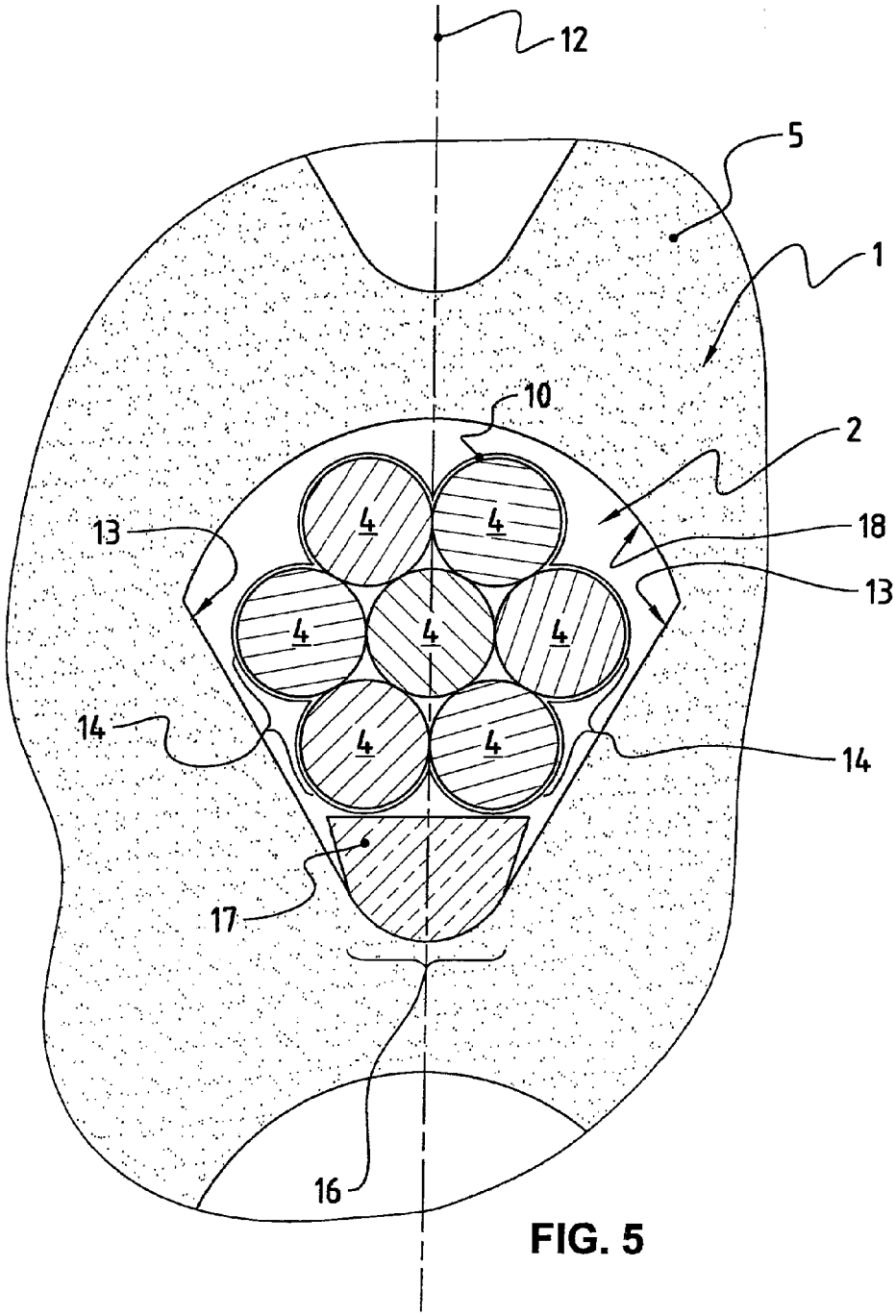

Represented in the drawings, in FIGS. 4 and 5, is a strand 2, which appears as a strand of the type called "strand without sheath or casing," but this is not of limiting character for the invention.

Figure 6:
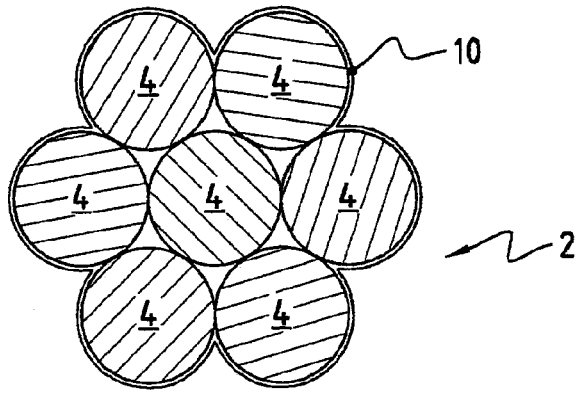
FIGS. 6 to 8: three views in cross section of a strand in different versions.

Such an unsheathed strand is represented in FIG. 6.

Figure 7:
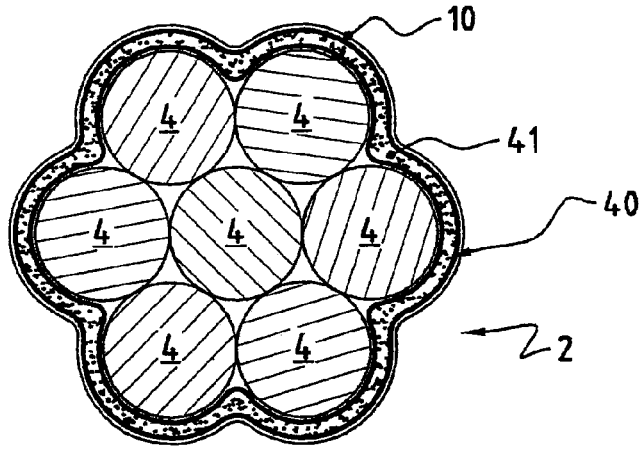

In contrast, a sheathed strand is a strand 2, the constituting wires 4 of which, on at least a portion of their length, are contained and/or enclosed in a sheath or casing 40, formed by at least one tubular wall 41 (FIG. 7), such as a tubular wall 41 made up of polyethylene material.

Figure 8:
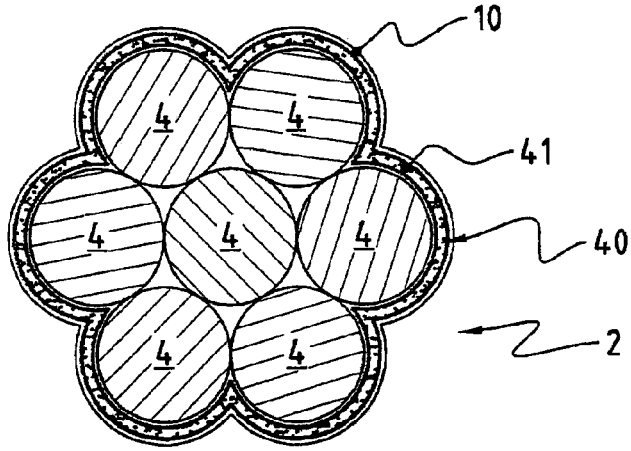

Likewise, a sheathed strand can also be a strand 2, the constituting wires 4 of which, on at least a portion of their length, are contained and/or enclosed in a sheath or casing 40, formed by at least one wall similar to a tubular wall 41, for example a wall made up by coating (FIG. 8), rolling or winding (version not shown) or any other method.

Taking as an example a wall made up by rolling or winding, a wall can be mentioned consisting of a layer of non-metallic material, for example polymeric material, such as epoxy, or even a layer of metallic material, for example of zinc.

Whatever the case may be, it must be borne in mind that the device of the invention can be used with a strand 2 which is sheathed, or with a strand 2 which is not sheathed.

The guiding device 1 comprises a body 5 in which at least one curved channel 6 is made, comprising a curved longitudinal axis 7 according to the curvature of said channel 6, and at least one first part 8 which, situated in principle at the side of the intrados of the longitudinal axis 7, permits, within the limit of the length of the channel 6, the support of the strand 2 on at least a portion of the peripheral face 10 of said strand 2.

Designated by longitudinal axis 7 is an axis which extends along the longitudinal dimension of the channel 6, but not obligatorily in a median position with respect to the transverse dimension of the channel 6 in a plane of curvature 12 of this channel 6.

As has been specified further above, the longitudinal axis 7 indicated has as a function to permit the definition of an intrados and of an extrados, the intrados being a first zone situated on the interior of the curve formed by this longitudinal axis 7, and the extrados being a second zone situated on the exterior of the curve formed by said longitudinal axis 7.

Preferably, the guiding device 1 comprises a body 5 in which at least one curved channel 6 is made with at least one second part 11 which, situated in principle at the side of the extrados of the longitudinal axis 7, is connected to the first part 8 and permits guiding of the strand 2 during its engagement in the channel 6, in particular in order to shape it in a plane of curvature 12 which contains the longitudinal axis 7 of the channel 6.

It must be considered that the peripheral face 10 of the strand 2 is made up of the portions of peripheral surfaces of the wires 4 which constitute it, or, possibly of portions of the peripheral surface of a sheath 40 which covers these wires 4.

In FIGS. 4 to 8, the shape of the peripheral face 10 of the strand is symbolized by a fine marking which covers the cross section of said strand 2.

In a noteworthy way, the first part 8 has a first cross section which is delimited by at least two faces of lateral contact, referred to as first faces 13, wherein the first faces 13 are:

- situated in such a way as to be able to co-operate locally with the part of the strand 2 which is engaged in the channel 6, and this in two lateral zones 14 of its peripheral face 10 which are situated on the both sides of the plane of curvature 12,
- oriented in such a way as to form between them an angle "A" predetermined at least sufficiently to initiate a phenomenon of clamping of the stand 2 when it receives a stress.

The guiding device 1 is thus constituted to define a support of the strand which support is possible to qualify as bilateral support.

This bilateral support is thus chosen for the situation and of limited extent so as to initiate a phenomenon of clamping of the strand 2.

Through this lateral support, a phenomenon of clamping is sought which is substantially identical to that sought in the field of pulleys for belts referred to as trapezoidal.

The engagement of the strand between the first faces 13 produces opposing actions (not shown) which induce a transverse clamping of said strand 2.

The clamping phenomenon is produced when the strand 2 comprises or does not comprise a sheath 40.

When the strand 2 comprises a sheath 40, the first faces 13 apply locally the sheath 40 against the strand 2, and also produce actions of clamping (not shown) which tend to be opposed:

- of sliding of wires 4 of said strand 2 in the sheath 40, and/or
- of sliding of the strand 2 in the channel 6.

Such as is shown, the guiding device 1 is connected to a support 9, such as a vertex of a pylon (not shown).

The two first faces 13 are situated on both sides of the plane of curvature 12.

The two first faces 13 are disposed symmetrically with respect to the plane of curvature 12.

One skilled in the art is able to determine the value of the angle that the two first faces 13 form, and this at least through successive trials.

One skilled in the art is also able to determine the value of the angle that the two first faces 13 form, and this by calculation, as a function of the coefficient of friction between the one and/or the other of these first faces 13 and the peripheral face 10 of the strand 2.

Advantageously, the first faces 13 are each substantially planar.

The first faces 13 can be smooth or can have reliefs.

In the first part 8 of the channel 6, the first faces 13 are connected by a second face 16 which is shaped and disposed so as to be shielded from any contact with the strand 2 when the latter is in lateral support on the first faces 13.

For example, the second face 16 has transverse generatrices which each extend substantially perpendicular to the plane of curvature 12.

In a preferred embodiment, the second face 16 has transverse generatrices which are curved in such a manner that, seen in cross section, this second face 16 appears substantially concave.

Whatever the case may be, said second face 16 is positioned in such a way as to be shielded from any contact with the strand 2 when the latter is in lateral support on the two first faces 13.

The guiding device 1 comprises at least one movable element 17 which, intended to be inserted in the channel 6 substantially before the insertion of a strand 2 and to be extracted from said channel 6 after putting in place of said strand 2, is constituted to be placed in support on the second face 16 and, when it is placed in support on said second face 16, forms a wedge which hinders the simultaneous pressing of the strand 2 on the two first faces 13.

Through this, the longitudinal displacement of the strand 2 in the channel can be obtained without clamping or initiation of clamping.

The withdrawal of the movable element 17 allows the strand 2 to be brought into support on the two first faces 13 and causes at least an initiation of clamping of this strand 2.

As concerns the second part 11, it is formed by a third face 18 defined by curved lines oriented for bringing about the sliding of the peripheral face 10 of the strand 2, during its engagement in the channel 6.

Preferably and in a noteworthy way, the second part 11 has a second cross section of substantially semi-circular shape.

In a noteworthy way, the third face 18 and the second face 16 are spaced in a manner at least sufficient so that, when a movable element 17 is situated resting on the second face 16, it can ensure its function without the engagement and the sliding of a strand 2 in the channel 6 being interfered with by a contact with the third face 18.

One skilled in the art is able to adjuster the proportions without demonstrating inventive activity.

One skilled in the art is likewise able to conceive of different ways to achieve the channels of the guiding device 1, and advantageous ways consisting in using tubes which, of cross section conforming to that defined, are embedded in a mass of material, such as concrete.

Likewise, the channels of the guiding device can also be created through molding.

The invention likewise concerns the constructions comprising the guiding device just described.

The invention claimed is:

1. Guiding device (1) for strands (2), the guiding device (1) comprising a body (5) in which at least one curved channel (6) is made, including a longitudinal axis (7) defining a plane of curvature (12), is curved according to the curvature of said channel (6) and:

at least one first part (8) which is positioned at the side of the intrados of the longitudinal axis (7), permits, within the limit of the length of the channel (6), the support of the strand (2) on at least a portion of the peripheral face (10) of said strand (2), this device being characterized in that the first part (8) has a first cross section which is delimited by at least two faces of lateral support, referred to as first faces (13), wherein the first faces (13) are:

situated in such a way as to be able to co-operate locally with the part of the strand (2) which is engaged in the channel (6), and forming two lateral zones (14) of its peripheral face (10) which are situated on the both sides of the plane of curvature (12), oriented in such a way as to form between the first faces an angle ("A") predetermined at least sufficiently to initiate a phenomenon of clamping of the strand (2) when it receives a stress.

2. Device according to claim 1, characterized in that, in the first part (8) of the channel (6), the first faces (13) are connected by a second face (16) which is shaped and disposed in such a way as to be shielded from any contact with the strand (2) when the strand is resting laterally on the first faces (13).

3. Device according to claim 2, characterized in that the second face (16) has transverse generatrices which are curved in such a way that, seen in cross section, this second face (16) appears substantially concave.

4. Device according to claim 2, characterized in that the guiding device (1) comprises at least one movable element (17) which is configured to be inserted in the channel (6) substantially before insertion of a strand (2) and to be extracted from said channel (6) after placement of said strand (2), is configured to be placed resting on the second face (16), and, when it is in place resting on said second face (16), forms a wedge which hinders the simultaneous pressing of the strand (2) on the two first faces (13).

5. Device according to claim 1 and of type comprising at least one channel (6) with at least a second part (11) which, situated in principle at the side of the extrados of the longitudinal axis (7) of said channel (6), is connected to the first part (8) and permits guiding of the strand (2) during its engagement in the channel (6), in particular in order to shape it in a plane of curvature (12) which contains the longitudinal axis (7) of the channel (6), this device being characterized in that said second part (11) is formed by a third face (18) defined by the curved lines oriented so as to cause the sliding of the peripheral face (10) of the strand (2), upon its engagement in the channel (6).

6. Device according to claim 5, characterized in that the third face (18) and the second face (16) are spaced in a manner at least sufficient so that, when a movable element (17) is situated resting on the second face (16), it can ensure its function without the engagement and the sliding of a strand (2) in the channel (6) being interfered with by a contact with the third face (18).

7. Device according to claim 5, characterized in that the second part (11) has a second cross section of substantially semi-circular shape.

8. Device according to claim 1, characterized in that the two first faces (13) are situated on both sides of the plane of curvature (12).

9. Device according to claim 1, characterized in that the two first faces (13) are symmetrically disposed with respect to the plane of curvature (12).

10. Device according to claim 1, characterized in that the first faces (13) are each substantially planar.

11. Constructions comprising the device according to claim 1.

* * * * *

UNITED STATES PATENT AND TRADEMARK OFFICE

CERTIFICATE OF CORRECTION

PATENT NO. : 7,900,306 B2
APPLICATION NO. : 12/296325
DATED : March 8, 2011
INVENTOR(S) : Yves Bournand et al.

It is certified that error appears in the above-identified patent and that said Letters Patent is hereby corrected as shown below:

Title Page, section (75) Inventors: for both inventors Gnagi and Tschaggelar, please delete "CN" and insert --CH--.

Signed and Sealed this
Thirteenth Day of December, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,900,306 B2
APPLICATION NO. : 12/296325
DATED : March 8, 2011
INVENTOR(S) : Yves Bournand, Adrian Gnagi and Hans Tschaggelar It is certified that error appears in the above-identified patent and that said Letters Patent is hereby corrected as shown below:

On the Title Page at item (73), please delete "Internationsl" and insert --International--.

Signed and Sealed this
Seventh Day of May, 2013

Teresa Stanek Rea
*Acting Director of the United States Patent and Trademark Office*